United States Patent [19]

Wier

[11] 4,243,343

[45] Jan. 6, 1981

[54] CONNECTOR

[76] Inventor: Jan H. Wier, "Burleigh" Bulls, New Zealand

[21] Appl. No.: 944,770

[22] Filed: Sep. 22, 1978

[51] Int. Cl.[3] ..... F16B 7/04

[52] U.S. Cl. ..... 403/397; 256/48; 24/81 CR

[58] Field of Search ..... 256/57, 48, 54, DIG. 3, 256/33, 10, 73 B, 73 SA, 84 B; 24/115 G, 81 CR, 255, 237; 403/397, 346, 395, 347, 398; 174/158 F, 161 F, 163 F; 47/44, 46, 47; 248/74 B, 74 PB, 74 A, 62

[56] References Cited

U.S. PATENT DOCUMENTS

| | | | |
|---|---|---|---|
| 692,529 | 2/1902 | Knittle | 24/735 A |
| 1,164,613 | 12/1915 | Jewell | 248/74 R |
| 1,245,047 | 10/1917 | Sherman | 248/74 R |
| 1,505,220 | 8/1924 | Shay | 248/316 D |
| 2,914,283 | 11/1959 | Jorgensen | 248/125 |
| 2,969,947 | 1/1961 | Tonnesson | 248/125 X |
| 3,233,297 | 2/1966 | Havener | 24/81 B |
| 3,253,811 | 5/1966 | Hanson | 248/74 A X |
| 3,377,038 | 4/1968 | Loudon | 248/62 X |
| 3,494,583 | 2/1970 | Parr | 248/226.5 X |
| 3,531,090 | 9/1970 | Laible | 256/54 |
| 3,562,873 | 2/1971 | Cumber | 24/81 B |
| 3,568,980 | 3/1971 | Hulburt et al. | 256/10 |
| 3,684,247 | 8/1972 | Oltmanns | 256/47 X |
| 3,827,815 | 8/1974 | Strange | 403/397 |

FOREIGN PATENT DOCUMENTS

| | | | |
|---|---|---|---|
| 17683 | of 1907 | United Kingdom | 248/74 A |

*Primary Examiner*—Andrew V. Kundrat

*Attorney, Agent, or Firm*—Scully, Scott, Murphy & Presser

[57] ABSTRACT

A connector particularly for a fencing system provided as a resilient shaped strip member with a curved longitudinal axis and including a pair of holes which may be aligned by compression of the strip member, and through which holes a fence post may be positioned. The ends of the strip member when so positioned on the post are juxtaposed, and a second fence member (being a fence wire etc.) may be passed there-between. The connector is positioned on the fence post by compression and provides a connection to the second fence member when said member is accommodated between the fence post and the juxtaposed ends of the said connector.

9 Claims, 5 Drawing Figures

CONNECTOR

This invention relates to a connector for positioning elongate members. The connector of the invention is particularly adapted for positioning fencing wire on a fencing post against lateral displacement. However, where the principles of the connector are useable for any other purposes, such purposes shall be deemed to be included in this invention.

It is an object of this invention to provide a connector for relatively positioning two elongate members, where facility is made for the connection or release of one elongate member from the connector such that the connector does not have to be removed from the one elongate member to which it is attached to effect such connection or release.

According to this invention there is provided a connector for positioning two elongate members in juxtaposition, comprising a shaped strip member being resiliently deformable by compression from a natural position to a compressed position where its two ends are in juxtaposition, a pair of holes provided through said strip member and adapted to receive a first elongate member therethrough when said strip member is in a compressed position, characterised in that the strip member is constrained against returning to its natural position by the first member when located through the pair of holes, to thereby secure the strip member by frictional engagement on the first elongate member; a second elongate member being locatable in the strip member between the first elongate member and the juxtapositioned ends of the strip member.

This invention further provides a connector for positioning a first elongate member being a fence post member in juxtaposition with a second elongate member being a second fence member; comprising a shaped strip member being resiliently deformable by compression from a natural position to a compressed position where its two ends are in juxtaposition, a pair of holes provided through said strip member and adapted to receive a fence post member therethrough when said strip member is in a compressed position, characterised in that the strip member is constrained against returning to its natural position by the fence post member when located through the pair of holes, to thereby secure the strip member by frictional engagement to a required position on the fence post member; the second fence member being locatable in the strip member between the fence post member and the juxtapositioned ends of the strip member.

Other objects and advantages of this invention will become apparent from the following description which is provided by way of example only. Reference will also be directed to the drawings which are representations of the preferred embodiment only of the invention and whilst approximately to scale are not limited to such dimensions. In particular, FIG. 1: is a side view of a connector according to one preferred form of the invention when not in use (and in its natural position).

Figure 2:
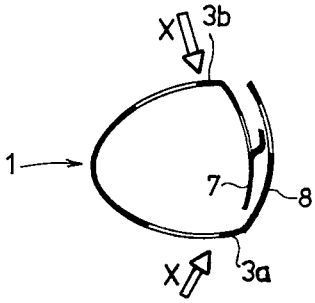

FIG. 2: is a side view of a connector according to one preferred form of the invention when in a compressed position.

Figure 3:
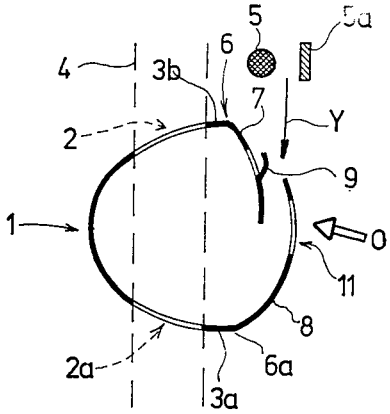
Figure 4:
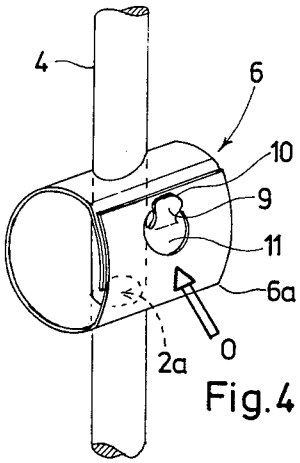
Figure 3A:
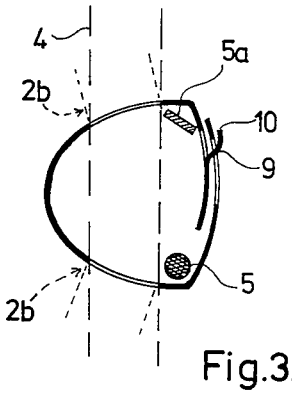

FIG. 3: is a cross-section view of a connector according to one preferred form of the invention when provided on a first elongate member or fence post and with the juxtapositoned ends of the connector in an "open" position as described herein FIG. 3A: is a cross-sectional view of the connector according to one preferred form of the invention when provided on the first elongate member and with the juxtaposed ends of the connector in a "closed" position as described herein FIG. 4: is a perspective view of a connector according to the preferred form of the invention shown in the preceding drawings.

The connector according to the present invention has a general application in relation to the connection of two elongate members in juxtaposition, and one preferred embodiment use of the connector is in relation to the attachment of a first elongate member or fence post member with a second elongate member or second fence member. Therefore, whilst following description will be particularly related to this the preferred embodiment of the invention, it will be appreciated that the invention as described would be adaptable for use in relation to the positioning of any pair of elongate members in juxtaposition, such as for the provision of connectors in the constructing of trellises, lattice work; or reinforcing such as may be used in concrete construction.

In particular, further reference in this specification to a fence post member can be considered as reference to a first elongate member, whilst reference to a second fence member, or fence wire may be substituted as reference to a second elongate member. Such a construction including for example fibreglass pultrusions and steel wire may be particularly useful for the purposes of reinforced concrete constructions and the construction of lattice works and trellises as suggested.

The following description will be directed to the preferred embodiment of the invention which may preferably be used in conjunction with elongate members comprising firstly, a fence post member constructed of a length of pultruded fibreglass material as is known in the art, and secondly a fence member being a fence wire or fence ribbon. This preferred use provides a fence construction which is lightweight, strong, and resilient and therefore has uses not only for permanent fencing, but particularly for temporary or "break fencing". In temporary fencing operations it is advantageous to attach and remove wires from posts quickly so that such temporary fences may be readily constructed and/or disassembled as required, and this invention in its preferred embodiment provides a connector to assist in such operations.

Figure 1:
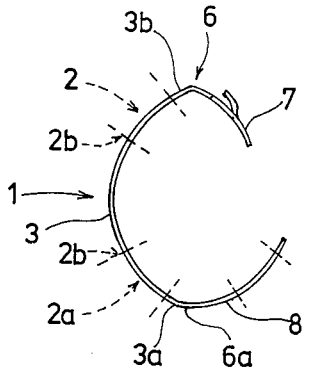

The invention therefore provides a connector being a strip member 1 which is shaped with a curved longitudinal axis adopting a "natural position" such as is shown in FIG. 1 of the drawings. In particular, the strip member is preferably a substantially rectangular strip as can be appreciated from FIG. 4 which is shaped to provide a curved longitudinal axis having a body portion 3 and end portions 7 and 8. The body portion 3 is preferably curved in such a manner as to be substantially symmetrical about a central lateral axis which can be considered as defining two arms 3*a* and 3*b*. The strip member is further shaped by the providing of bends at 6 and 6*a* on the arms 3*a* and 3*b* respectively of the body portion. This further shaping of the strip member thereby provides the pair of end members 7 and 8 which are inwardly depending. The shaped strip member is deformable and resilient, and in the preferred form of the invention may be manufactured in spring stainless steel, or galvanised steel for protection against corrosion. The shaped strip member 1, shown in FIG. 1 in its natural position, is deformable from this position, by compression of the arms 3*a* and 3*b* of the member towards each other. The resilience of the material of the strip member is such that this compression can be exerted by manual (finger) compression or for example by suitably adapted pliers. Preferably, the pressure simultaneously exerted on both arms 3*a* and 3*b* of the strip member where shown by the arrows X on FIG. 2 of the drawings will thereby compress the shaped strip member to a compressed position as is shown in FIG. 2.

In such position, the two ends 7 and 8 of the shaped strip member are provided in juxtaposition, and the pair of holes 2 and 2*a* are disposed towards co-axial alignment one with the other. The holes 2 and 2*a* are furthermore provided of such dimensions as to receive a fence post. The holes may be of circular, elliptical, or other suitable shape which generally corresponds to the cross-sectional shape of the fence post. In the form of the invention shown the holes are of circular dimensions of a diameter slightly larger than the diameter of the fence post. When the strip member is compressed, it is adapted to receive said fence post which may be inserted therethrough.

The connector, being the shaped strip member 1, may then be positioned as required on the post by maintaining the compression shown by arrows X, and moved along the fence post to the required position. When so positioned on the fence post 4 the resilience of said shaped strip member is such that when the compression indicated by arrows X is released, the shaped strip member returns toward its natural position. However, this return of the connector to its natural position is constrained by the fence post 4 located through the pair of holes 2 and 2*a*. The peripheral edges of the holes are in sufficient frictional contact with the fence post as to secure the connector thereon.

The connector is then in the position shown in FIG. 3 of the drawings whereby it is secured to the fence post member 4, and where the ends 7 and 8 of the shaped strip member are provided in juxtaposition. With reference to FIG. 3 of the drawings, a fence wire 5 can be passed between the juxtaposed ends 7 and 8 of the connector as is shown by the directional arrow Y. The fence wire 5 is then located in the connector between the fence post 4 and the juxtaposed ends 7 and 8, which position is shown in FIG. 3*a* of the drawings.

Thereby, according to the invention, the first elongate member (fence post 4) is connected by the connector 1 to the second elongate member (fence wire 5) so as to provide a connection there-between.

The frictional contact of the shaped strip member on the fence post 4, will be sufficient to counter any excessive load which may be placed on the connector by the second fence member, for example by an animal resting on the fence when constructed. The invention according to the preferred embodiment further provides that the juxtaposed ends 7 and 8 of the connector are preferably curved in a convex manner as shown in the drawings, and are resilient so that when the connector is positioned on a post, a fence wire can be passed between the two juxtaposed ends with no substantial effect on the frictional contact of the arms 3*a* and 3*b* of the shaped strip member on the fence post 4.

Alternatively, the juxtaposed ends may be provided such that they abut one against the other, or merely overlap one another, so as to provide an enclosed area in which the fence wire may be positioned. In the preferred form of the invention, the end members may be engaged by an interlocking arrangement provided by a catch 9 which can be punched out of the surface of said end member 7 in any suitable shape as may be required. In the preferred shape, the catch 9 may be semi-circular in plan, and project above the surface of the end member 7 as is shown in FIG. 4.

The end member 8 is provided with a corresponding hole indicated by arrow 11. The diameter of the said hole is larger than the diameter of the semi-circular area which is punched to form catch 9. To engage hole 11 with catch 9 and close the connector in the preferred form, it is simply necessary to apply manual pressure (eg finger pressure) at arrow O. The hole 11 will then pass over the lip 10 of the said catch 9 and because of its resilient convex shape the end member 8 will, when released slide into a position shown in FIG. 3A of the drawings. Similarly, the ends of the connector may be disengaged to open by simply applying the same thumb (finger) pressure at arrow O as shown on FIG. 4. It will be seen from the drawings, that FIG. 3 thereby represents the preferred embodiment of the end members in the "open" position whilst FIG. 3A represents the end members in the "closed" position. The particular advantage of this curved shape of the end portions of 7 and 8 is that the second fence member can be readily passed in and/or out of the connector.

Furthermore, the gap between said end portions 7 and 8 is sufficient to permit any other suitable fence means such as ribbon 5*a* or the like to be passed therebetween. The catch 9 on the end portion 7 is also shaped so that it does not obstruct the positioning of the fence wire or ribbon in the connector.

The invention therefore provides a connector which may be readily adjustable in height for the fence when constructed to contain animals and to which a second possibly electrified fence means, for example a fence wire or fence ribbon may be readily engaged or disengaged for efficient use and operation. The above description may be adapted to describe use of the invention for the other purposes suggested, particularly in relation to the use of pultruded fibre glass rods. The invention is described by way of example only and modifications alterations and additions may be made without departing from the scope thereof.

I claim:

1. A connector for transversely positioning two elongate members in juxtaposition, comprising a shaped strip member being resiliently deformable by compression from a natural position, to a compressed position where its two ends are in juxtaposition; a pair of holes provided through said strip member and adapted to receive a first elongate member therethrough when said body portion is in a compressed position: characterised in that the body portion is constrained against returning to its natural position by the first member when located through the pair of holes, to thereby secure the strip member by a frictional engagement to a required position on the first elongate member; an enclosure being formed in said connector between said first elongate member and the ends of the strip member when in juxtaposition, in which enclosure a second elongate member is locatable so as to be freely moveable both axially and relative to said first elongate member within the limits defined by said enclosure.

2. A connector as claimed in claim 1 wherein the first elongate member is a fence post member and the second elongate member is a second fence member.

3. A connector according to claim 2 wherein said fence post member is a pultruded fibreglass member.

4. A connector according to claim 2 wherein said second fence member is a fence wire or fence ribbon.

5. A connector as claimed in claim 2 wherein the shaped strip member includes a curved longitudinal axis to provide a body portion substantially symmetrical about a central lateral axis so as to define two extending arms, which arms are bent to provide inwardly depending end members.

6. A connector as claimed in claim 5 wherein the inwardly depending end members are juxtaposed so as to abut, overlap, or so adapted as to be mutually engageable, when the connector is positioned on the first elongate member.

7. A connector as claimed in claim 1 wherein the holes are of a shape generally corresponding to the cross-sectional shape of the first elongate member, so that the connector when provided in its compressed position is adapted to receive the first elongate member therethrough.

8. A connector according to claim 7 wherein the juxtaposed end members are adapted for mutual engagement by a catch provided on one end member engageable in a corresponding hole or recess provided on said other end member.

9. A connector according to claim 1 comprised of resilient spring stainless steel or resilient galvanized steel.

* * * * *